US005718376A

United States Patent [19]

Cox et al.

[11] Patent Number: 5,718,376

[45] Date of Patent: Feb. 17, 1998

[54] RAILWAY RAIL-FASTENING CLIP AND ASSEMBLY

[75] Inventors: Stephen John Cox, Richmond; Barry Marshall; Christopher Gardner, both of Sheffield; Martin David Somerset; Brian George Conroy, both of Worksop, all of United Kingdom

[73] Assignee: Pandrol Limited, Addlestone, United Kingdom

[21] Appl. No.: 737,025

[22] PCT Filed: Mar. 1, 1996

[86] PCT No.: PCT/GB96/00455

§ 371 Date: Jan. 6, 1997

§ 102(e) Date: Jan. 6, 1997

[87] PCT Pub. No.: WO96/27708

PCT Pub. Date: Sep. 12, 1996

[30] Foreign Application Priority Data

Mar. 3, 1995 [GB] United Kingdom ..... 9504328

[51] Int. Cl.[6] ..... E01B 9/00

[52] U.S. Cl. ..... 238/349; 238/351

[58] Field of Search ..... 238/350, 349, 238/351, 343, 338, 315

[56] References Cited

U.S. PATENT DOCUMENTS

| | | | |
|---|---|---|---|
| 3,297,253 | 1/1967 | Astley et al. | 238/349 |
| 3,658,246 | 4/1972 | Davies | 238/349 |
| 4,718,604 | 1/1988 | Eisenberg et al. | 238/349 |
| 5,042,717 | 8/1991 | Vanotti | 238/349 |
| 5,069,386 | 12/1991 | Duval | 238/349 |
| 5,170,937 | 12/1992 | Vanotti | 238/84 |
| 5,203,501 | 4/1993 | Vanotti | 238/265 |

*Primary Examiner*—Mark T. Le

*Attorney, Agent, or Firm*—Norbert P. Holler

[57] ABSTRACT

A resilient rail-fastening clip has a first straight portion (11) for locating the clip in a clip anchoring device (2) when the clip is in use, a second bent portion (12), a third heel portion (13), a fourth bend portion (14) and a fifth toe portion (15). When viewed such that lower most points of the first and fifth portions (11 and 15) of the clip lie in a horizontal plane, proceeding from the first portion (11), the second portion (12) appears to bend up out of that plane towards and then away from a vertical plane passing through the fifth portion (15). The clip (1) is used in an assembly including a baseplate (2) having a non-vertical stop (**21*d*) on its shoulder (21) up which the clip (1) slides during installation until brought to rest through friction at a desired height above the rail (3**).

14 Claims, 6 Drawing Sheets

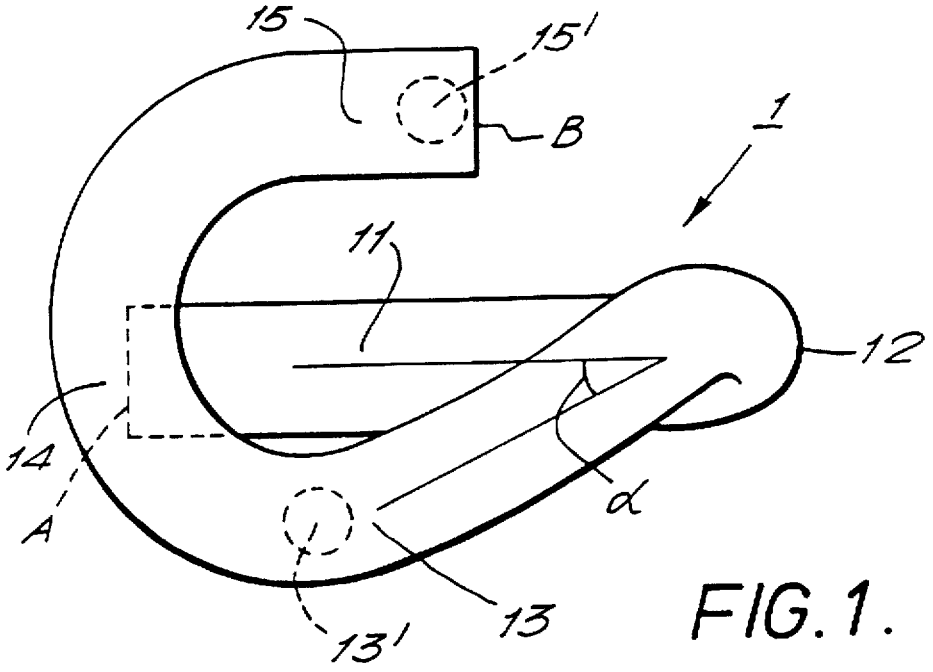
FIG. 1.
FIG. 2.
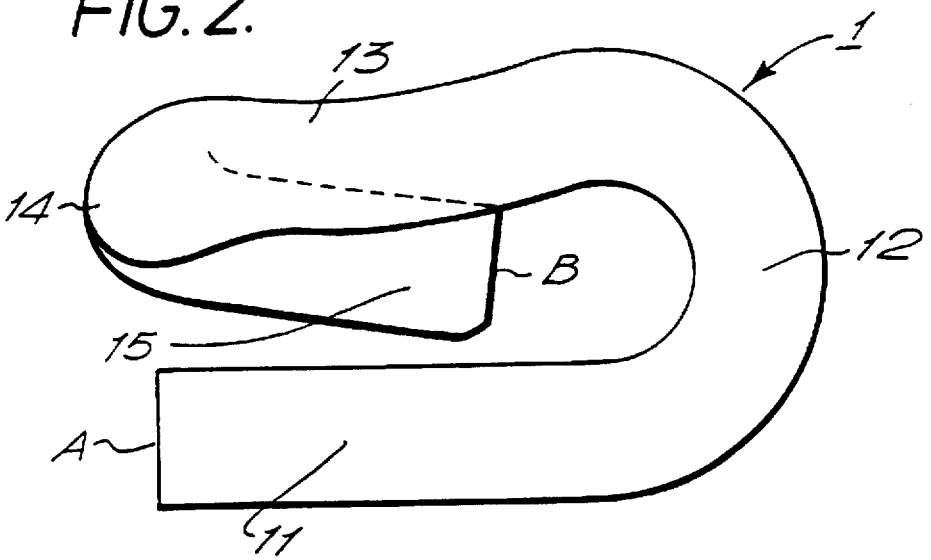

1
1'
2
3
5
11
12
13
13'
14
15
15'
20
21
21a
21b
21c
21d
21e
21'
22'
23
24'
25
26
30
A
B

RAILWAY RAIL-FASTENING CLIP AND ASSEMBLY

The present invention relates to a railway rail-fastening clip and assembly.

A railway rail fastening assembly supplied by the applicants and used in parts of the U.S.A. comprises a rolled steel baseplate, secured to a wooden sleeper by screwspikes, and rail clips, known as "e-clips" and disclosed in GB-A-1510224. The rail clips concerned have a first straight centre leg portion, a bent second portion, a third heel portion, a fourth portion and a fifth toe portion. When the clip is placed in an orientation such that the longitudinal axes of the third and fifth portions lie in the same horizontal plane, the third and fifth portions appear (when the clip is viewed from above or below that horizontal plane) to lie on opposite sides respectively of the said first portion. In this orientation both the bent second portion and the bent fourth portion of the clip are arched such that they each appear to have a rising part followed by a falling part. Respective shoulders having tunnels for receiving the centre leg of such clips are provided, on either side of a rail seat area, by deforming the rolled steel plate. Load from the rail is distributed through the baseplate to the wooden sleeper.

Although the performance of such assemblies has been generally satisfactory, the applicants have found that in the locations, particularly on curves, where the assembly is used, the forces to which the assembly is subjected can break the baseplate, especially in the area of the baseplate around the tunnel. When loaded, there is also a tendency for the portions of the baseplate outboard of the tunnels to bend upwards relative to the portion under the rail, owing to the flexibility of the baseplate in the areas around the tunnels, so that the load is not well distributed across the full width of the plate. The applicants have also found that damage can occur to the rail clips and baseplates of such assemblies during train derailments, and that displacement of the rail clips can occur owing to contact with track maintenance equipment, etc. Both these problems are caused by the height of the assembly which is at its greatest at part of the clip, since the clip must have a pronounced arch in the fourth portion of the clip to allow it to clear the shoulder during installation.

With a view to strengthening the baseplate the applicants herein propose that the tunnel height is reduced, thereby allowing the thickness of material above the tunnel to be increased without increasing the overall height of the shoulder. Such a reduction in tunnel height may alternatively permit a small but significant overall reduction in the height of the shoulder. Reducing the height of the tunnel also allows the inclination of the tunnel side walls (which inclination is provided to aid manufacture) to be reduced, which in turn decreases the width of the tunnel at its foot, and thereby increases the bearing area and the strength of the baseplate around the tunnel. The plate's stiffness in bending is also increased so that the distribution of load across its width is improved.

According to a first aspect of the present invention, there is provided a railway rail fastening clip made from a rod of resilient material bent so as to have, proceeding from one end of the rod to the other, a first substantially straight portion for locating the clip in a clip anchoring device when the clip is in use, then a second bent portion, then a third portion, then a fourth bent portion and finally a fifth portion, the said second portion being bent substantially along its entire length, and one of the said third and fifth portions having a first contact region which bears against an upper exterior surface portion of the clip anchoring device when the clip is in use and the other of the said third and fifth portions having a second contact region which bears against a rail adjacent to the said clip anchoring device when the clip is in use, such that, when the clip is in an unstressed condition and is placed in an orientation in which the longitudinal axes of the rod at the first and second contact regions of the clip lie in a first horizontal plane, the said third and fifth portions of the clip lie on opposite sides respectively of said first portion when viewed from directly above or below said first horizontal plane, wherein, when the unstressed clip is placed in an orientation in which respective lowermost points of the said first and fifth portions of the clip lie in a second horizontal plane and is viewed from directly above or below that plane, proceeding from the said first portion the said second portion appears no bend out of that second horizontal plane towards and then away from a vertical plane passing through the said fifth portion.

Such a clip is suitable for use with the improved baseplate described above. The clip is designed such that the rod works mostly in torsion, which is more efficient.

An embodiment of the clip is preferably such that the longitudinal axis of the fourth portion of the clip lies substantially in or below the said first horizontal plane.

Since no part of the centre line of the clip is significantly higher than the plane containing the centres of the rod at the first and second contact regions of the clip the profile of the clip relative to the clip anchoring device is much lower, and the likelihood of clip damage and displacement is much reduced.

Such a reduction in clip profile may be achieved by tapering the part of the free end of the said first portion of the clip which is uppermost when the clip is in use, and/or an upper interior surface of the said passageway in the said clip anchoring device if it is a cast plate, such that as the clip is installed in the clip anchoring device the first portion of the clip is driven downwardly, thereby bringing about at least some deflection of the clip whilst substantially avoiding any tendency for the said fourth portion to be distorted during such installation of the clip in such a way that the lowermost point thereof is caused to lie substantially above the said first horizontal plane.

The applicants believe that, since the centre line of the fourth portion of the clip lies substantially in a horizontal plane when the clip is in use, the clip may perform better when subjected to the lateral forces caused by the passage of rail traffic. In particular, on rare occasions the arched fourth portion of the "e-clip" can break due to fatigue, as friction between the clip and the rail is sufficient to prevent sideways movement of the clip under such lateral forces, thereby causing the fourth portion to bow. However, the flat fourth portion of a clip embodying the first aspect of the present invention is stiffer and it is thought that the clip will therefore be able to overcome the friction with the rail and will slide rather than bow.

A superficial resemblance to a clip embodying the first aspect of the present invention may be considered to exist in the clips described in U.S. Pat. No. 4,350,291 (Dobson), U.S. Pat. No. 718,604 (Eisenberg et al) and U.S. Pat. No. 5,042,717 (Vanotti). However, none of the clips has a second portion, proceeding from a straight centre leg, which bends towards and then away from the fifth portion of the clip. Moreover, each clip has a pronounced arch between the third and fifth portions of the clip which is such that the centre line of the clip in this region lies significantly above the first and second contact points. In fact, the Vanotti clip has an even higher profile, since between its vertical portion and its first contact point the height of the clip is greater than between the first and second contact points.

The first contact of one embodiment of the Eisenberg clip is normal to the plane of the rear arch, which does generate torsion in the rear arch, but this is achieved by designing the baseplate with which the clip is used so as to have a relatively thin, substantially vertical, upstand on top of the shoulder to one side of the passageway therethrough. Such an upstand can only be made on a cast plate, which is much more expensive than a rolled steel plate. Moreover, a commonly-used method of rail installation, particularly in the U.S., involves using a crane to swing a rail into position above pre-positioned baseplates from alongside the track. As the rail is flexible and bends along its length, placement of the rail is not very precise and thus such relatively flimsy upstands would be susceptible to damage and the baseplates likely to be displaced. The Eisenberg et al assembly is therefore impractical.

The Dobson clip is intended to be used on existing baseplates having no tunnels to receive the centre leg of the clip. Instead channels are cut across the wooden sleepers to receive the clip centre leg, which is generally not acceptable since the channel collects water and the wood rots, so the system has not hitherto been generally adopted.

Unlike the afore-mentioned "e-clips" and clips embodying the first aspect of the present invention, the Vanotti clip is installed vertically and then rotated into a locking position.

According to a second aspect of the present invention there is provided a railway rail fastening assembly for fastening a railway rail to an underlying rail foundation, which assembly comprises first and second railway rail fastening clips embodying the first aspect of the present invention, and a baseplate formed on one major face thereof with a rail seat area, on which the said railway rail is sitting, located between respective clip anchoring portions which extend at least partially across the plate, each clip anchoring portion having a passageway therethrough through which there extends the said first portion of one of first and second rail fastening clips, the said first contact region of each rail fastening clip contacting an upper part of an exterior surface of the clip anchoring portion with which that clip is engaged, which upper part is upwardly inclined with respect to the other major face of the baseplate such that, as the clip is driven into the clip anchoring portion, the first contact region of the clip can slide laterally up the said upper part until it is brought to rest through friction at a height relative to that of the said second contact region, which bears on a flange of the said railway rail, which is such as to ensure that the clip exerts a desired load on said rail.

Unlike the baseplate of Eisenberg et al, a baseplate for use in an assembly embodying the second aspect of the present invention does not have a near-vertical upstand. The baseplate is therefore much less susceptible to damage during rail laying, and the baseplate itself need not be cast but may be made of rolled steel plate.

Desirably, the exterior surface of each clip anchoring portion is designed such that it provides a lead-in effect for the rail as it is lowered into position. In other words, the shaping of the shoulders preferably facilitates threading of the rail through the shoulders, in such a way that the target area in which the rail is placed is effectively larger and the shoulders themselves help to funnel the rail into the correct location. This shaping may be achieved without using an undesirably large amount of material and without leaving any part of the shoulder protruding dangerously far above the main body of the baseplate.

For example, the exterior surface of the clip anchoring portion may be shaped such that its cross-section is wedge-shaped, that is such that proceeding from the rail seat area of the plate it presents a flat upwardly-inclined surface. Preferably, however, the said upper part is concave, with a radius of curvature of 50. In this case, the remainder of the clip anchoring portion may be substantially flat, and inclined for example at an angle of approximately 18° to the other major face of the said baseplate.

Alternatively, the baseplate may instead be shaped such that, when the top of the clip anchoring portion is viewed in a direction parallel to the longitudinal axis of the said passageway, a lower surface portion thereof appears to approximate to a convex curve and an upper surface portion thereof appears to approximate to a concave curve. In this case the said upper part may comprise a substantially flat surface, which is preferably inclined at an angle of 37° with respect to the said other major surface of the said baseplate, the exterior surface of the clip anchoring part being shaped so as to have, proceeding from the rail seat area, a substantially vertical face, a first upwardly-inclined face, a substantially horizontal face above the passageway, a second upwardly-inclined face constituting the said upper part, and a downwardly-inclined, face, the said first upwardly-inclined face and the said downwardly-inclined face being inclined respectively at a lesser angle and a greater angle than the second upwardly-inclined face. Preferably, the edge at which the said second upwardly-inclined face joins said downwardly-inclined face is rounded.

Reference will now be made, by way of example, to the accompanying drawings, in which:

FIGS. 1, 2 and 3 show respective plan, side elevational and rear elevational views of a railway rail fastening clip embodying the first aspect of the present invention;

Figure 3:
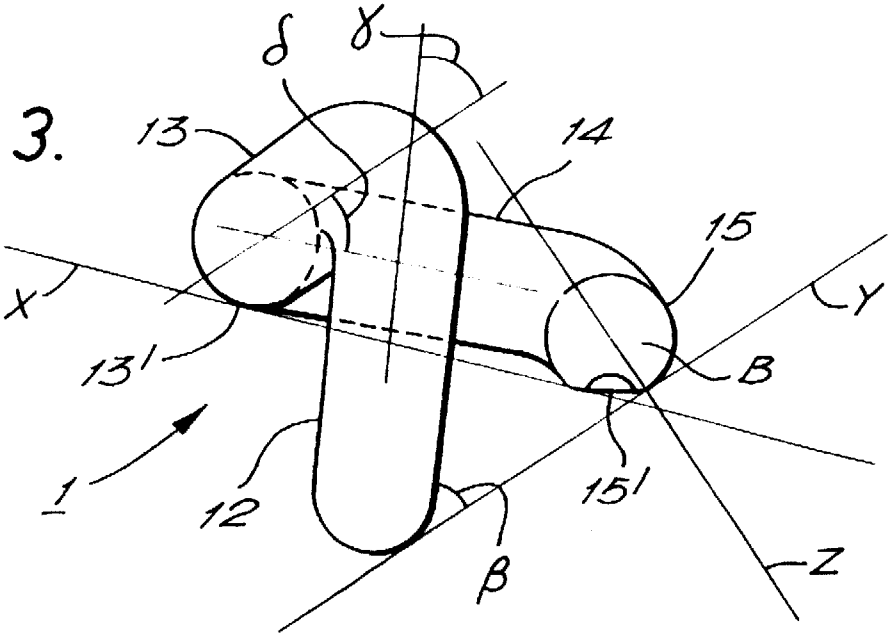

The rail clip 1 shown in FIGS. 1, 2 and 3 is made by bending a rod of resilient material, which is, in this case, circular in cross-section (for example a steel rod), so as to have, proceeding from one end A of the rod to the other end B, a straight first centre portion 11, a second portion 12 bent through substantially 180°, a substantially straight third portion 13, a fourth portion 14 which is bent through substantially 180° and a straight fifth portion 15. The third portion 13 has a first contact region 13' and the fifth portion 15 has a second contact region 15'.

The centre portion 11 is used for locating the clip in a clip anchoring device (for example the base plate shown in FIG. 4), when the clip is in use. The portion 12 forms a rear portion, and the fourth portion 14 forms a front portion. When viewed in plan, as in FIG. 1, the centre portion 11 does not extend beyond the front portion 14 and the fifth portion 15 does not extend beyond the rear portion 12.

When the clip 1 is placed in an orientation such that the longitudinal axes of the clip at the first and second contact regions 13', 15' lie in a first horizontal plane X and the clip is viewed from directly above or below, the centre portion 11 appears to lie between the third and fifth portions 13, 15.

When the clip is placed in an orientation such that the lowermost points of the centre and fifth portions 11 and 15 are in a second horizontal plane Y, the rear portion 12, proceeding from the centre portion 11, appears to curve out of that horizontal plane Y towards and then away from a vertical plane Z passing through the longitudinal axis of the fifth portion 15.

When made from a rod 19 mm thick, the clip is, for example, 114 mm and 79 mm at its longest and widest parts respectively, and 71 mm high at its highest point. The fifth portion extends approximately halfway along the clip 1. The angle α in FIG. 1 is approximately 28°, and the angles β, γ, δ in FIG. 3 are approximately 53°, 53° and 45° respectively.

The rail clip 1 is used in combination with a clip anchoring device. An example of a suitable anchoring device is a baseplate 2 shown in FIG. 4 which comprises a substantially rectangular base section 20 on which there are formed a pair of shoulders 21, 21' having respective tunnels 22, 22' formed therein, on either side of a rail seat area 23. The rail seat area 23 has a slight cant, in this case about 1 in 40, so as to incline the rail. The baseplate 2 is asymmetric with respect to a centre line through the rail seat area 23 such that the "field" side 24' of the baseplate 2, which is on the outside of the track when the plate is in use, extends further beyond the neighbouring shoulder 21' than does the "gauge" side 24, in view of the different loading experienced across the track. The baseplate 2 is secured to an underlying railway sleeper or tie when in use by means of screwspikes (not shown) inserted through holes 25 (round in this example, but they could be square if lockspikes are used instead of screwspikes) provided through the plate 2 in the outer "field" and "gauge" regions 24', 24 thereof. The edges of the "field" and "gauge" regions 24', 24 are flat so that the screwspikes bear evenly. The baseplate 2 is provided on its lower major face with respective optional ribs 26, extending across the plate beneath the rail seat area 23 parallel to the shoulders 21, for preventing lateral movement of the plate 2.

The baseplate 2 is a rolled steel plate in which the shoulders 21, 21' and tunnels 22, 22' run parallel to the shorter sides of the plate 2 and have been formed by deforming the plate appropriately. The roof of each tunnel 22, 22' is curved. The profile of the exterior surface of each shoulder 21, 21' is such that, proceeding from the rail seat area 23, each shoulder 21, 21' has a substantially vertical side face 21*a*, an upwardly sloping inner face 21*b*, a substantially horizontal platform 21*c* above the tunnel 22, 22' another upwardly sloping inner face 21*d* which is more steeply inclined than the sloping face 21*b*, a rounded summit 21*e*, and a downwardly sloping steep outer face 21*f*. In the example shown, the face 21*b* slopes at an angle of 19° to the horizontal, whereas the slope on the face 21*d* is 37° and that on the face 21*f* is 80°.

In this example, the base section 20 of the plate 2 is 200 mm by 444 mm, the plate being 12 mm thick at the outer regions 24 thereof. The holes 25 are 25.4 mm in diameter and their centres are located 25.4 mm from the shorter and longer sides of the plate 2. The rail seat area 23 is 154 mm wide, its centre line being 191 mm from one of the shorter edges of the plate and 253 mm from the other. The centre of the tunnel 22 in one shoulder 21 is 84 mm from the nearest shorter edge and this tunnel 22 is 23 mm high and 24 mm wide at its foot. The centre of the tunnel 22' in the other shoulder 21' is 146 mm from the nearest shorter edge and this tunnel is 28 mm high and 29 mm wide at its foot. The centre of each tunnel 22, 22' is 30 mm from the respective nearest edges of the rail seat area 23, and the roof of each tunnel 22, 22' has a radius of curvature of 10.5. The platform 21*c* of each shoulder 21, 21' is 14 mm above the roof of the tunnel 22, 22'. The side walls of the tunnel slope at an angle of 3° to the vertical. Each shoulder 21, 21' has an approximately vertical face 21*a* of height 12 mm, a first inclined face 21*b* of length 25 mm, a platform 21*c* of length 12 mm, a second inclined face 21*d* of length 22 mm, a rounded summit 21*e* having a radius of curvature of 4, and a downwardly-inclined face 21*f* of length 30 mm. The maximum heights of the shoulders 21, 21' at the rounded summits 21*e* are 50 mm and 55 mm respectively.

In contrast the prior art Pandrol baseplate described above, when also made of plate of thickness 12 mm, has tunnel heights of 35 mm and 30 mm respectively, side walls inclined at angles in the range from 11.5° to 15.5° to the vertical and tunnel foot widths of 47 mm and 44 mm respectively.

Figures 5, 6:
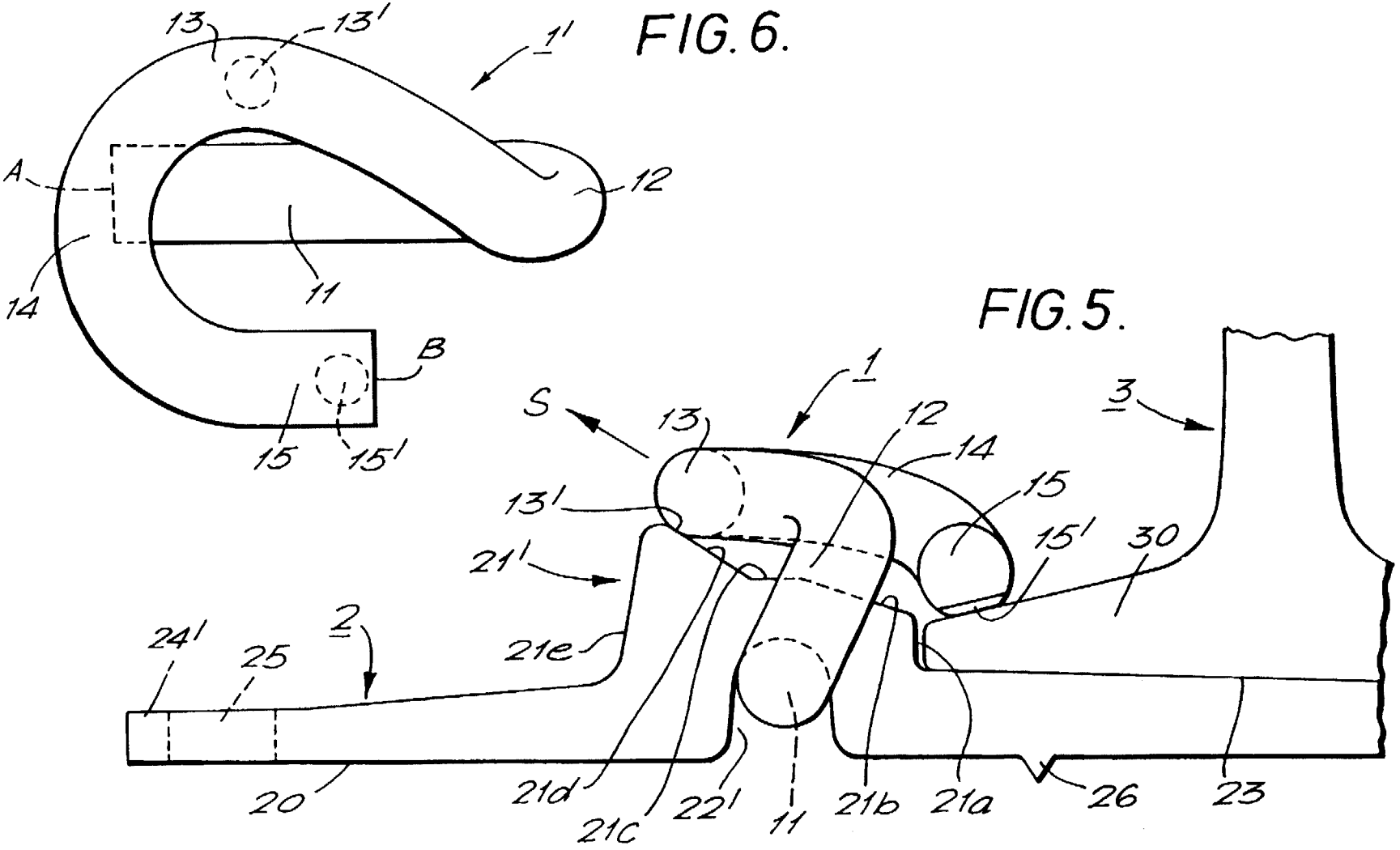
FIG. 5 shows a first railway rail-fastening assembly embodying the second aspect of the present invention.
FIG. 6 shows another clip embodying the present invention.

FIG. 5 shows part of the baseplate 2 having a rail clip 1 installed in one of its shoulders 21. In installation the clip 1 is brought up to the entrance of the tunnel 22 or 22' such that the centre portion 11 is upwardly-inclined with respect to the longitudinal axis of the tunnel. As the centre portion 11 of the clip 1 is driven into the tunnel 22 or 22' by striking the rear portion 12 or pulling the front portion 14, either manually or possibly using automatic clip driving equipment, the centre portion 11 moves downwards, deflecting the clip 1.

As the clip 1 is driven the third portion 13 slides sideways (in the direction of arrow S in FIG. 5). The sloping inner face 21*d* of the shoulder 21 acts as a stop for resisting such lateral movement of the clip 1 as it is driven into the shoulder 21. The third portion 13 of the clip therefore slides laterally up the sloping inner face 21*d* until it is brought to rest through friction at a height relative to that of the second contact region 15', which has come no bear on the flange 30 of the rail 3, such as to ensure that the clip 1 exerts the desired "toe" load on the rail 3 to retain the rail 3 in position. The angle of inclination of the sloping inner face 21*d* is therefore determined, at least to a large extent, by the characteristics of the clip with which it is to be used, including the toe load the clip is intended to impart. The contact between the clip 1 at the first contact region 13' and the sloping inner face 21*d* is such that the clip 1 remains in stable equilibrium, delivering its full toe load on the rail, without generating large forces at the first contact point which give rise to excessive wear of the shoulder 21. The shape of the top surface of the shoulder serves to provide a single normal contact point, so that the clip bears perpendicularly on this top surface, thereby reducing bending in the rear portion 12 and increasing the torsion in the third portion 13.

The shape of the rear portion 12, towards and away from the fifth portion 15, serves to ensure that the third portion 13 experiences a predominantly torsional load when the clip is in use, thereby increasing the efficiency of the clip.

Figure 4:
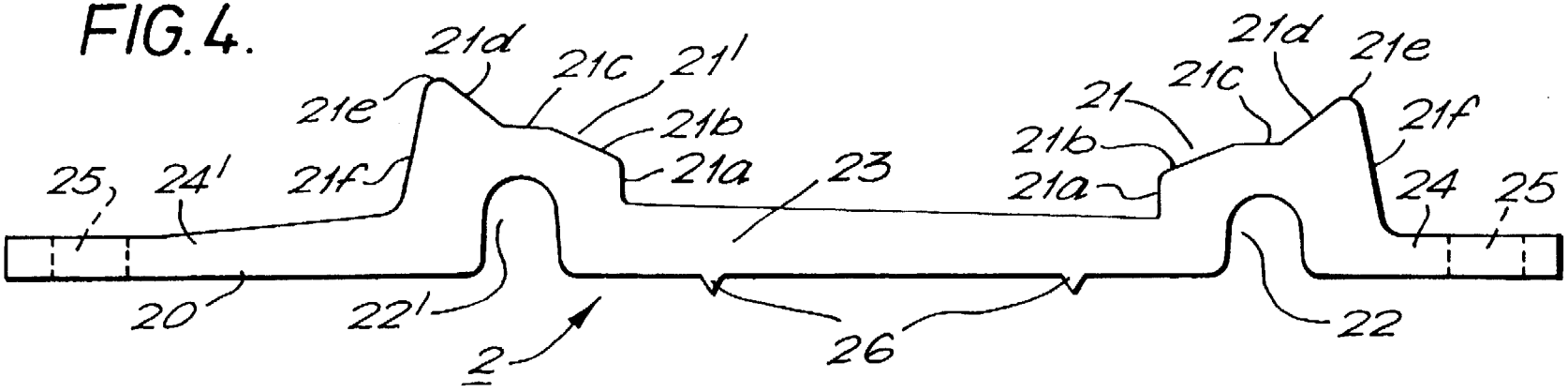
FIG. 4 shows a first baseplate for use with the clip of FIGS. 1 to 3 in an assembly embodying the second aspect of the present invention.
Figure 7:
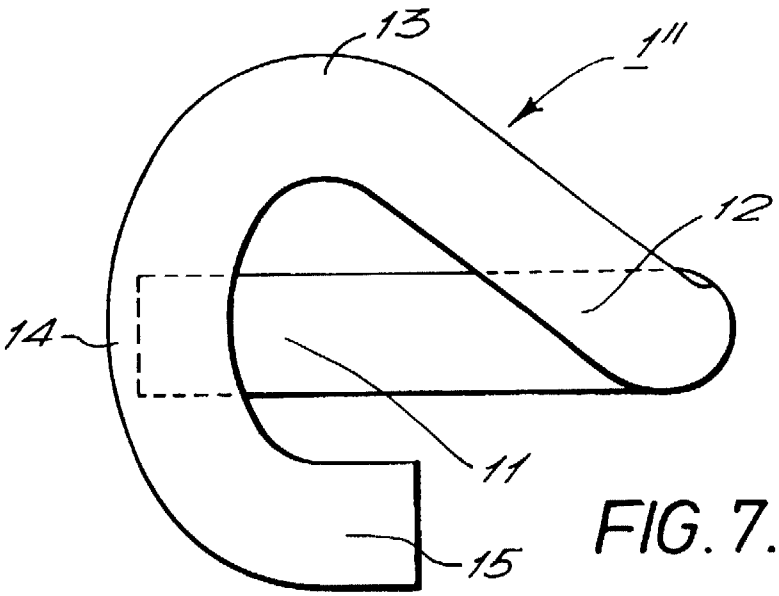
FIG. 7 shows a further clip embodying the present invention.
Figure 8:
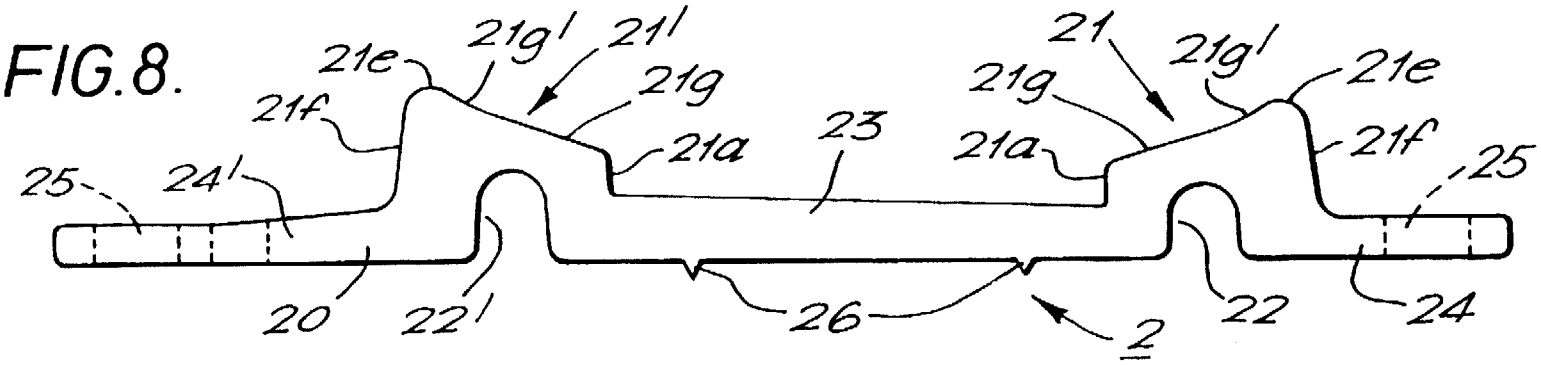
FIG. 8 shows a second baseplate for use in an assembly embodying the second aspect of the present invention.
Figure 9:
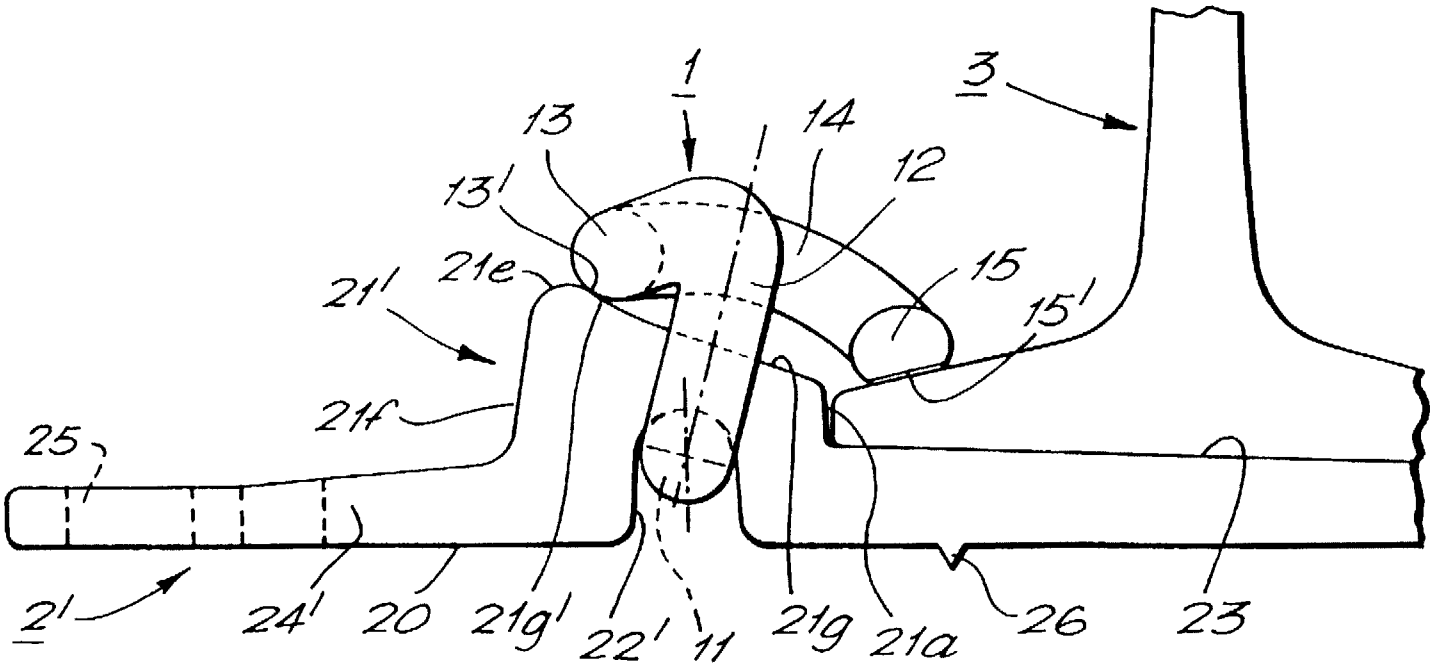
FIGS. 9 and 10 show respective clips embodying the first aspect of the present invention in an assembly embodying the second aspect of the present invention.
Figure 10:
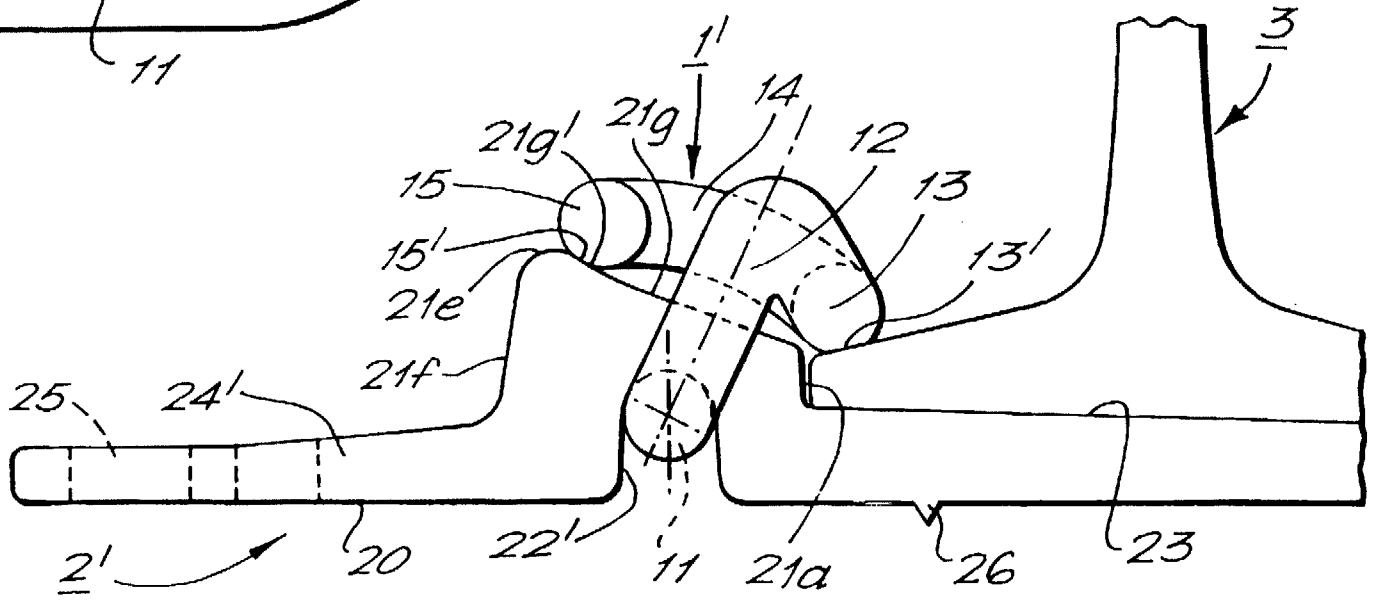

Instead of the clip 1 of FIGS. 1 to 3, a clip 1', shown in FIG. 6, which is formed so as to be the mirror image of the clip 1, may be used. Another clip 1", shown in FIG. 7, is similar to the mirror image clip 1', bun has a less curved fourth portion Any of the clips 1, 1' or 1" may be used with a baseplate 2 such as shown in FIG. 4, or with a modified baseplate 2' such as shown in FIG. 8. FIG. 9 shows part of the baseplate 2' in which a clip 1 has been installed to hold down the rail 3, whereas FIG. 10 shows part of the baseplate 2' in which a clip 1' has been installed to hold down the rail 3.

The baseplate 2' differs from the baseplate 2 in that instead of the angled surfaces 21*b*, 21*c* and 21*d* of the upper surface of each shoulder 21, 21', the upper surface is formed so as to have an upwardly inclined surface 21*g* which is substantially flat except at an upper part 21*g*', adjacent to the summit 21*e* of the shoulder 21, 21', where it is concave. In a baseplate 2', similar in all other respects and dimensions to the baseplate 2 described above, the upper part 21*g*' has a radius of curvature of 50, the rounded summit 21*e* has a radius of curvature of 8, and the remainder of the upper surface 21*g* is inclined at an angle of 17.6° to the face 20 of the baseplate 2'.

An assembly embodying the present invention has a lower profile, typically by about 10 mm, when viewed parallel to the axis of the rail, than the previously-used assembly. This means that the clips are less likely to be displaced or knocked by track maintenance equipment or by items trailing from vehicles. Also, the clips and plates embodying the present invention are less likely to be damaged by derailed wheels because the assembly height in the area where derailed wheels most commonly run is considerably lower than in previously-proposed designs and because the plate is considerably stronger.

Figure 11:
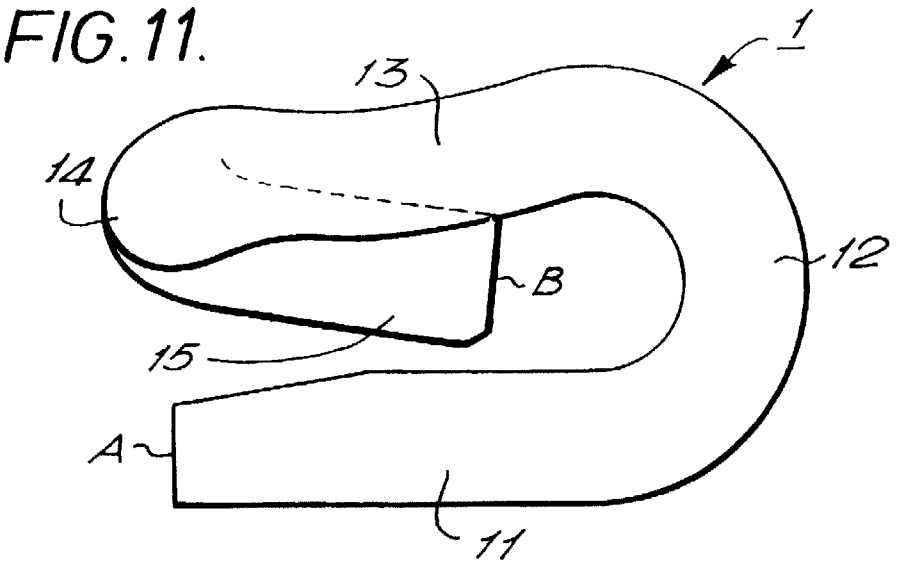
FIG. 11 shows yet another clip embodying the present invention.

Although it may be more expensive to manufacture, achievement of a low profile clip may be assisted by tapering the free end of the centre portion, as shown in FIG. 11, so as to cause some of the required clip deflection to be generated by driving the centre leg downwards, rather than driving the third or fifth portions 13, 15 upwards, thereby avoiding the distortion of the curved front portion 14 which such upward movement of the third or fifth portions 13, 15 can cause. Alternatively, the centre portion 11 can be driven downwards when it is inserted into the tunnel 22 of a cast base plate 2 by tapering the roof of the tunnel 22 (not shown).

We claim:

1. A railway rail fastening clip (1, 1', 1") made from a rod of resilient material bent so as to have, proceeding from one end of the rod to the other, a first substantially straight portion (11) for locating the clip (1, 1', 1") in a clip anchoring device (2, 2') when the clip (1, 1', 1") is in use, then a second bent portion (12), then a third portion (13), then a fourth bent portion (14) and finally a fifth portion (15), the said second portion (12) being bent substantially along its entire length, and one of the said third and fifth portions (13, 15) having a first contact region (13', 15') which bears against an upper exterior surface portion of the clip anchoring device (2, 2') when the clip (1, 1', 1") is in use and the other of the said third and fifth portions (13, 15) having a second contact region (13', 15') which bears against a rail (3) adjacent to the said clip anchoring device (2, 2') when the clip (1, 1', 1") is in use, such that, when the clip (1, 1', 1") is in an unstressed condition and is placed in an orientation in which the longitudinal axes of the rod at the first and second contact regions (13', 15') of the clip (1, 1', 1") lie in a first horizontal plane (X), the said third and fifth portions (13, 15) of the clip (1, 1', 1") lie on opposite sides respectively of said first portion (11) when viewed from directly above or below said first horizontal plane (X), wherein, when the unstressed clip (1, 1', 1") is placed in an orientation in which respective lowermost points of the said first and fifth portions (11, 15) of the clip (1, 1', 1") lie in a second horizontal plane (Y) and is viewed from directly above or below that plane, proceeding from the said first portion (11) the said second portion (12) appears to bend out of that second horizontal plane (Y) towards and then away from a vertical plane (Z) passing through the said fifth portion (15).

2. A clip as claimed in claim 1, wherein the longitudinal axis of the fourth portion (14) of the clip (1, 1', 1") lies substantially in or below the said first horizontal plane.

3. A clip as claimed in claim 2 in combination with a clip anchoring device (2, 2') secured to a rail foundation and having a passageway therein for receiving the said first portion of the clip (1, 1', 1"), wherein a part of a free end of the said first portion (11) of the clip (1, 1', 1") which is uppermost when the clip (1, 1', 1") is in use, and/or an upper interior surface of the said passageway in the said clip anchoring device (2, 2'), is/are tapered such that as the clip (1, 1', 1") is installed in the clip anchoring device (2, 2') the first portion (11) of the clip (1, 1', 1") is driven downwardly, thereby bringing about at least some deflection of the clip (1, 1', 1") whilst substantially avoiding any tendency for the said fourth portion (14) to be distorted during such installation of the clip (1, 1', 1") in such a way that a lowermost point thereof is caused to lie substantially above the said first horizontal plane.

4. A railway rail fastening assembly for fastening a railway rail (3) to an underlying rail foundation, which assembly comprises first and second railway rail fastening clips (1, 1', 1"), and a baseplate (2, 2') formed on one major face thereof with a rail seat area (23), on which the said railway rail (3) is sitting, located between respective clip anchoring portions (21, 21') which extend at least partially across the plate;

wherein each of the first and second railway rail fastening clips (1, 1', 1") is made from a rod of resilient material bent so as to have, proceeding from one end of the rod to the other, a first substantially straight portion (11), then a second bent portion (12), then a third portion (13), then a fourth bent portion (14) and finally a fifth portion (15), the said second portion (12) being bent substantially along its entire length, and one of the said third and fifth portions (13, 15) having a first contact region (13', 15') and the other of the said third and fifth portions (13, 15) having a second contact region (13', 15'), the portions of each clip being arranged such that, when the clip (1, 1', 1") is in an unstressed condition and is placed in an orientation in which the longitudinal axes of the rod at the first and second contact regions (13', 15') of the clip (1, 1', 1") lie in a first horizontal plane (X), the said third and fifth portions (13, 15) of the clip (1, 1', 1") lie on opposite sides respectively of said first portion (11) when viewed from directly above or below said first horizontal plane (X), and, when the unstressed clip (1, 1', 1") is placed in an orientation in which respective lowermost points of the said first and fifth portions (11, 15) of the clip (1, 1', 1") lie in a second horizontal plane (Y) and is viewed from directly above or below that plane, proceeding from the said first portion (11) the said second portion (Y) appears to bend out of that second horizontal plane (Y) towards and then away from a vertical plane (Z) passing through the said fifth portion (15); and wherein each said clip anchoring portion (21, 21') has a passageway (22, 22') therethrough through which there extends the said first portion (11) of one of the said first and second rail fastening clips (1, 1', 1"), the said first contact region (13', 15') of each rail fastening clip (1, 1', 1") contacting an upper part (21*d*; 21*g*') of an exterior surface of the clip anchoring portion (21, 21') with which that clip (1, 1', 1") is engaged, which upper part (21*d*; 21*g*') is upwardly inclined with respect to another major face (20) of the baseplate (2, 2') such that, as the clip (1, 1',1") is driven into the clip anchoring portion (21, 21'), the first contact region (13', 15') of the clip (1, 1', 1") can slide laterally up the said upper part (21*d*; 21*g*') until it is brought to rest through friction at a height relative to that of the said second contact region (13', 15'), which bears on a flange of the said railway rail (3), which is such as to ensure that the clip (1, 1', 1") exerts a desired load on said rail (3).

5. An assembly as claimed in claim 4, wherein the said upper part (21*d*) comprises a substantially flat surface.

6. An assembly as claimed in claim 5, wherein the flat surface is inclined at an angle of 37° with respect to the said other major face (20) of the baseplate (2, 2').

7. An assembly as claimed in claim 4, wherein the said upper part (21*g*) is concave.

8. An assembly as claimed in claim 7, wherein a remainder of the exterior surface of the said clip anchoring portion (21, 21') is substantially flat.

9. An assembly as claimed in claim 8, wherein the flat portion (21*g*) of the said exterior surface is inclined at an angle of approximately 18° to said other major face (20) of the baseplate (2, 2').

10. An assembly as claimed in claim 4, wherein the exterior surface of the clip anchoring portion (21, 21') is shaped such that, when the top of the clip anchoring portion (21, 21') is viewed in a direction parallel to the longitudinal axis of the said passageway (22, 22'), a lower surface portion (21*b*, 21*c*) thereof appears to approximate to a convex curve and an upper surface portion (21*c*, 21*d*) thereof appears to approximate to a concave curve.

11. An assembly as claimed in claim 4, wherein the exterior surface of the clip anchoring portion (21, 21') is shaped so as to have, proceeding from the rail seat area (23), a substantially vertical face (21*a*), a first upwardly-inclined face (21*b*), a substantially horizontal face (21*c*) above the passageway (22, 22'), a second upwardly-inclined face (21*d*) constituting the said upper part, and a downwardly-inclined face (21*f*), the said first upwardly-inclined face (21*b*) and the said downwardly-inclined face (21*f*) being inclined respectively at a lesser angle and a greater angle than the second upwardly-inclined face (21*d*).

12. An assembly as claimed in claim 11, wherein the edge (21*e*) at which the said second upwardly-inclined face (21*d*) joins said downwardly-inclined face (21*f*) is rounded.

13. An assembly as claimed in claim 4, wherein the longitudinal axis of the fourth portion (14) of each of the first and second railway rail fastening clips (1, 1', 1") lies substantially in or below the said first horizontal plane.

14. An assembly as claimed in claim 4, a part of a free end of the said first portion (11) of each of the first and second railway rail fastening clips (1, 1', 1") which is uppermost when the clip (1, 1', 1") is in use, and/or an upper interior surface of the said passageway in each of the said clip anchoring portions (21, 21'), is/are tapered such that as the clip (1, 1', 1") is installed in the clip anchoring portion (21, 21') the first portion (11) of the clip (1, 1', 1") is driven downwardly, thereby bringing about at least some deflection of the clip (1, 1', 1") whilst substantially avoiding any tendency for the said fourth portion (14) to be distorted during such installation of the clip (1, 1', 1") in such a way that a lowermost point thereof is caused to lie substantially above the said first horizontal plane.

* * * * *